US009619995B2

(12) United States Patent
Namazi et al.

(10) Patent No.: US 9,619,995 B2
(45) Date of Patent: Apr. 11, 2017

(54) MULTI-PARTY WIRELESS NOTIFICATION SYSTEM

(71) Applicant: Intelletto Technologies Inc., Ontario (CA)

(72) Inventors: Hassanali Namazi, Ontario (CA); Homayoun Ahmadi, Ontario (CA)

(73) Assignee: Intelletto Technologies Inc., Ontario (CA)

( * ) Notice: Subject to any disclaimer, the term of this patent is extended or adjusted under 35 U.S.C. 154(b) by 0 days.

(21) Appl. No.: 14/826,347

(22) Filed: Aug. 14, 2015

(65) Prior Publication Data

US 2017/0046944 A1 Feb. 16, 2017

(51) Int. Cl.
*G08B 23/00* (2006.01)
*G08B 27/00* (2006.01)

(52) U.S. Cl.
CPC ..... *G08B 27/00* (2013.01)

(58) Field of Classification Search
CPC ..... G08B 27/005
USPC ..... 340/502
See application file for complete search history.

(56) References Cited

U.S. PATENT DOCUMENTS 8,554,875 B1 * 10/2013 Alfaro ..... H04L 67/18 709/218
2002/0046299 A1 * 4/2002 Lefeber ..... H04L 29/06 719/318
2008/0114830 A1 * 5/2008 Welingkar ..... G06F 17/30575 709/203
2013/0031191 A1 * 1/2013 Bott ..... G06F 21/552 709/206
2013/0212229 A1 * 8/2013 Vastardis ..... G06Q 50/01 709/219
2014/0074696 A1 * 3/2014 Glaser ..... G06Q 20/341 705/39
2014/0282040 A1 * 9/2014 Alfaro ..... H04L 51/20 715/739
2014/0282075 A1 * 9/2014 Alfaro ..... H04L 67/22 715/751

(Continued)

*Primary Examiner* — Santiago Garcia
(74) *Attorney, Agent, or Firm* — Westman, Champlin & Koehler, P.A.

(57) ABSTRACT

A multi-device alert notification system that includes a trigger device that has a low energy wireless transmitter for broadcasting an alert message in unlicensed spectrum for mobile user devices when activated, and a remote server system storing information that identifies the trigger device, the remote server being configured to receive, through a network, an alert notification message from each of a plurality of mobile user devices, each alert notification message indicating that the mobile user device has received the alert message from the trigger device and including a unique trigger device identifier and a unique user identifier associated with the mobile user device. The remote server system receives, through the network, an alert acceptance request message from one of the mobile user devices that includes the unique trigger device identifier and the unique user identifier associated with the mobile user device and sends notification messages to at least the mobile user devices that did not send the alert acceptance request message indicating that the alert message from the trigger device has been accepted by one of the plurality of mobile user devices.

20 Claims, 20 Drawing Sheets

(56) References Cited

U.S. PATENT DOCUMENTS

| | | | | |
|---|---|---|---|---|
| 2015/0043523 | A1* | 2/2015 | Luo | H04W 16/14 370/330 |
| 2015/0082212 | A1* | 3/2015 | Sharda | H04L 67/26 715/764 |
| 2015/0296385 | A1* | 10/2015 | Zhang | H04W 16/14 370/329 |
| 2015/0319781 | A1* | 11/2015 | Damnjanovic | H04W 16/14 370/330 |
| 2015/0348012 | A1* | 12/2015 | Hursta | G06Q 20/28 705/39 |
| 2016/0127451 | A1* | 5/2016 | Yerli | H04L 67/10 709/203 |

* cited by examiner

313

503-1

| Adv. Length | Type Local Name | Data |
|---|---|---|
| 0X13 | 0X09 | Device Identifier (18 Bytes) |

704

503-2

| Adv. Length | Type Flags | Data | Adv. Length | Type Sevice UUID | Data | Adv. Length | Type Custom Data | Company ID | Data |
|---|---|---|---|---|---|---|---|---|---|
| 0X02 | 0X01 | 0X05 | 0X11 | 0X06 | UUID 16 Bytes | 0X05 | 0XFF | 0X9001 | Custom Data 2 Bytes |

705

706

FIG. 14

MULTI-PARTY WIRELESS NOTIFICATION SYSTEM

FIELD

This description relates to wireless communications systems and methods, and in particular to systems and methods in which multiple parties are alerted to an event.

BACKGROUND

Alert systems today can be as simple as a door bell to a more sophisticated system that transfers data, audio or images. Such systems rely on communications to transmit alerts either by wire or wireless from a trigger point to a base system. For example a conventional wireless door bell usually has a trigger button and a base station installed at a location where the alerts can be heard. In such a setting a door bell is unlikely to be heard if the user is away from the range of the base system. Also, in the example of a conventional door bell, the alert takes the form of a sound that will be heard by all users in a vicinity of the door base station. Thus, the alert lacks privacy where only selected users are desired to receive a particular alert. Furthermore, such an alert system does not provide confirmation that someone is responding to it. Such issues can be inconvenient in a residential setting, but take on even more importance when an alert system is used in an office or other business areas such as restaurants or hospitals.

SUMMARY

According to an example embodiment is a multi-device alert notification system that includes a trigger device that has a low energy wireless transmitter for broadcasting an alert message in unlicensed spectrum for mobile user devices when activated, and a remote server system storing information that identifies the trigger device, the remote server being configured to receive, through a network, an alert notification message from each of a plurality of mobile user devices, each alert notification message indicating that the mobile user device has received the alert message from the trigger device and including a unique trigger device identifier and a unique user identifier associated with the mobile user device. The remote server system receives, through the network, an alert acceptance request message from one of the mobile user devices that includes the unique trigger device identifier and the unique user identifier associated with the mobile user device and sends notification messages to at least the mobile user devices that did not send the alert acceptance request message indicating that the alert message from the trigger device has been accepted by one of the plurality of mobile user devices.

According to example embodiments is a method for notifying multiple devices of a received alert, including receiving at a server system, through a network, an alert notification message from each of a plurality of mobile user devices, each alert notification message indicating that the mobile user device has received an alert message from a trigger device and including a unique trigger device identifier and a unique user identifier associated with the mobile user device. The method also includes receiving at the server system, through the network, an alert acceptance request message from one of the mobile user devices that includes the unique trigger device identifier and the unique user identifier associated with the mobile user device; and sending, from the server system, notification messages to at least the mobile user devices that did not send the alert acceptance request message, the notification messages indicating that the alert message from the trigger device has been accepted by one of the plurality of mobile user devices.

According to example embodiments, there is also provided a method of processing alert notifications at a mobile user device, including: receiving, in unlicensed spectrum through a low energy wireless receiver, an alert message broadcast from a trigger device, the alert message comprising a unique trigger device identifier; sending, to a remote server system, a user notification when the alert message is received from the trigger device; and sending, to the remote server system, a further user notification when the mobile user device receives a user input indicating user acceptance of the alert message.

BRIEF DESCRIPTION OF THE DRAWINGS

Reference will now be made, by way of example, to the accompanying drawings which show example embodiments of the present application, and in which:

FIGS. 13 and 14 illustrate examples of alert messages sent by a trigger device of the system of FIG. 1;

Similar reference numerals may have been used in different figures to denote similar components.

DESCRIPTION OF EXAMPLE EMBODIMENTS

Figure 1:
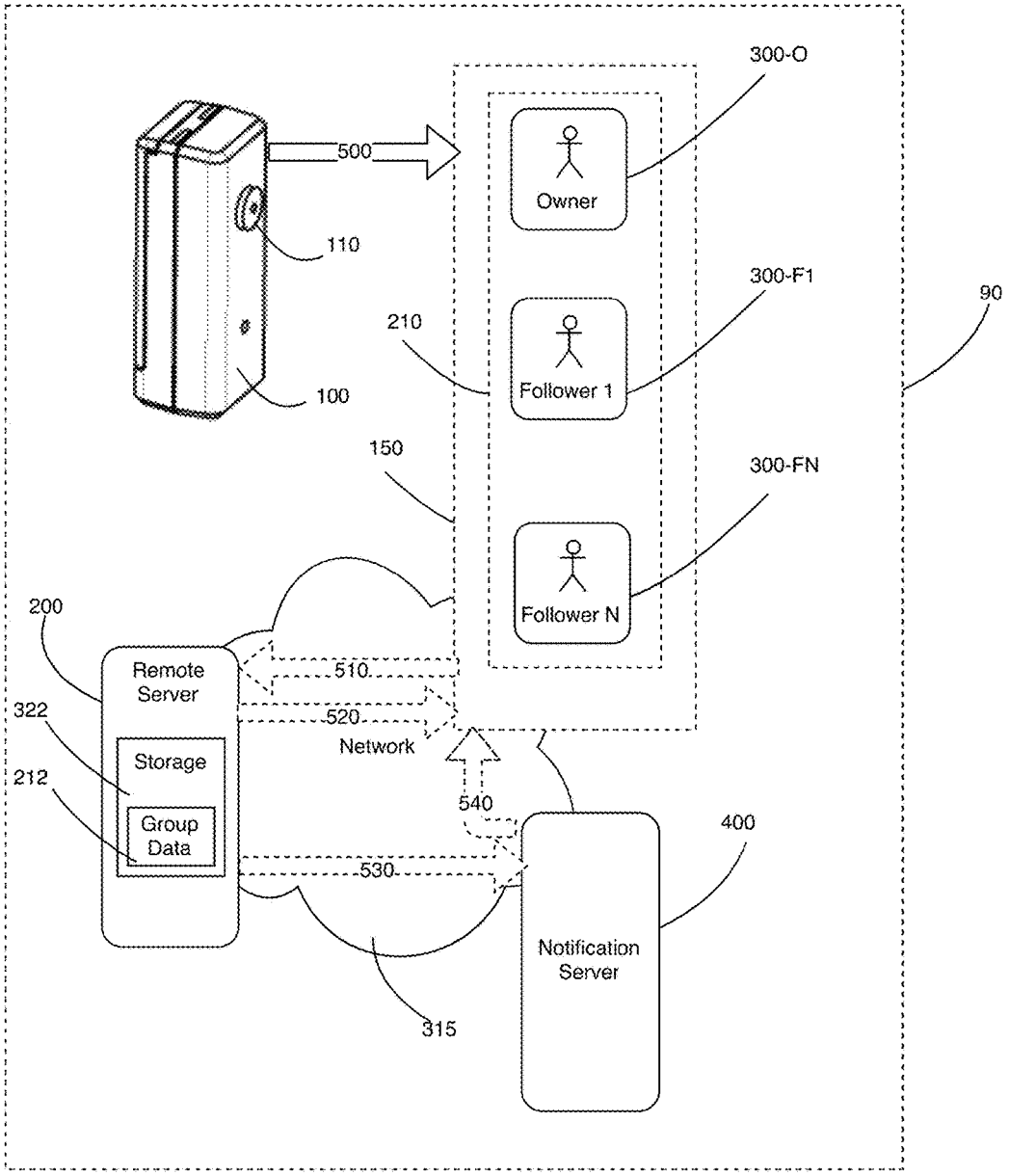
FIG. 1 is a schematic diagram of a multi-party wireless notification system according to an example embodiment.

FIG. 1 shows a multi-user notification system 90 according to an example embodiment. The notification system 90 includes at least one trigger device 100 that broadcasts wireless alerts for mobile user devices 300-O, 300-F (referred to generically by reference 300) that are in a wireless transmission range 150 of the trigger device 100. In various embodiments, user devices 300 can be configured to subscribe to one or more selected trigger devices 100 and ignore alerts from other devices 100. In some embodiments, devices 300 that subscribe to a particular trigger device 100 are notified if one of the other subscribed devices 300 accepts a specific alert. In some embodiments one or more remote servers 200 are provided and trigger identifier and timestamp and user acceptance information is tracked in order to perform certain tasks or measure productivity in a business or enterprise setting. In some embodiments, third party notification servers 400 may be used to exchange information with devices 300.

In at least some example embodiments, trigger devices 100 and mobile devices 300 each incorporate a low energy communications radio for communication in open, unlicensed frequency spectrum such as the ISM spectrum. In some example embodiments, the low energy communications radio is a Bluetooth™ compliant low energy device. As known in the art, Bluetooth low energy devices can be defined in different roles. Two roles, which are capable of making two-way communications and thus can operate in a connectable role manner, include the "peripheral" and "central" device roles. A device that can make a two-way connection can act as a peripheral role device that is an advertiser (e.g. sends out advertising information in the form of advertising packets) and operates as a slave in a connection. This could be, for example, a health thermometer or a heart rate sensor. A central device is a device that can make connections to other devices and which scans for advertising information from advertisers and can initiate connections; such a device operates as a master in one or more connections. Examples of devices that are capable of performing the central device role are smart phones and computers. Thus, two types of Bluetooth low energy device roles used for establishing two-way connections are the peripheral and the central roles.

Two Bluetooth device roles that are only capable of making one-directional communication include the "broadcaster" device role and the "observer" device role. A broadcaster, for example, is a non-connectable advertiser such as a temperature sensor that broadcasts the current temperature. A one-directional Observer scans for advertising information, but cannot initiate connections—for example, a remote display that receives the temperature data from a temperature broadcaster and presents it visually.

In both the broadcaster and peripheral roles the same type of advertising information is transmitted with the exception of one specific flag in the advertising packet that indicates if the advertiser device is connectable or non-connectable. A peripheral role device can store its data according to the Bluetooth Smart Technology specifications. In this manner a peripheral role device implements a GENERIC ATTRIBUTE PROFILE (GATT) Server, which defines the architecture for how data is stored and exchanged between two or more devices.

Figure 2:
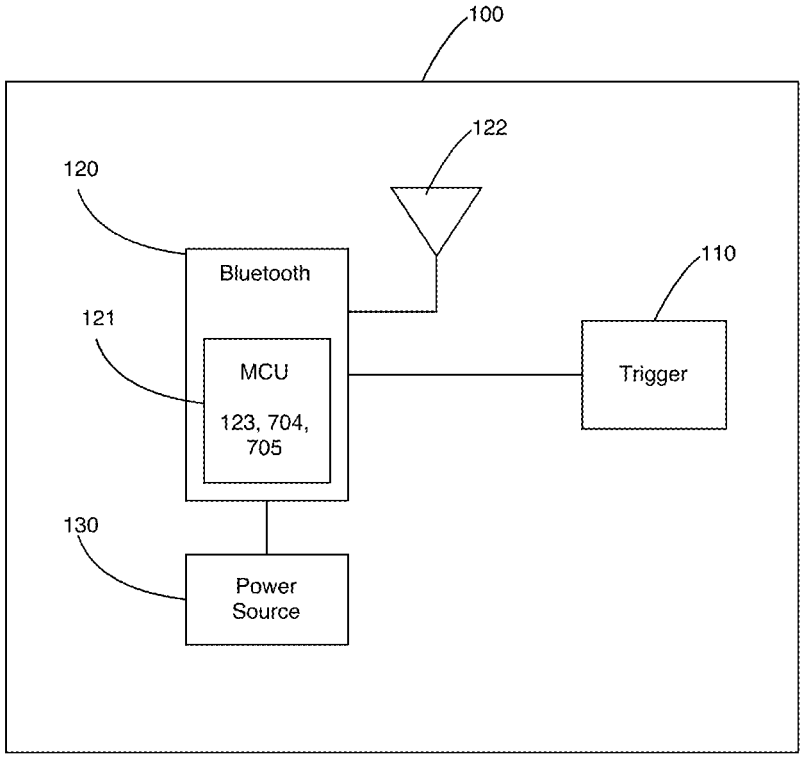
FIG. 2 is a block diagram of a trigger device of the system of FIG. 1.

FIG. 2 illustrates one possible configuration of a trigger device 100 according to example embodiments. Specific devices may utilize all of the components shown, additional components that are not shown, or only a subset of the components and levels of integration may vary from device to device. Furthermore, a device may contain multiple instances of a component, such as multiple processing units, processors, memories, transmitters, receivers, etc. A typical trigger device 100 consists of a low energy Bluetooth radio 120 and antenna 122 and a control unit 121 that intercepts trigger signals from at least one trigger element 110. The trigger device 100 is powered by a power source 130 in a form of battery pack or other means. Trigger element 110 can take a number of forms—in the example of FIG. 1, the trigger element 110 is a touch sensing element in the form of a physical button that provides generates a trigger signal when depressed. Trigger element 110 could take the form of other types of sensing elements such as a temperature sensor, pressure sensor, magnetic sensor, sound sensor, infrared heat sensor, positional sensor, smoke sensor, CO sensor, fluid sensor, gas sensor, odor sensor, current sensor and light sensor, among other things. Trigger element 110 could also include a receiver for sensing transmitted signals that result in a trigger, or could include a timer for generating a trigger at specified times or after a specified time duration. MCU 121 has associated storage 123 that includes instructions that configure the trigger device 100 to perform the trigger device-side functions described herein that relate to notification system 90. Storage 123 also includes a unique identifier 704 for the trigger device 100, and a shared identifier 705 that identifies the trigger device 100 as belonging to a class or group of trigger devices.

In example embodiments, the trigger device 100 is a dedicated trigger device such that its primary function is to provide a trigger signal upon the occurrence of a predetermined trigger action—for example the device 100 in FIG. 1 is a dedicated "door bell" style device that transmits a Bluetooth advertising packet (described in greater detail below) when the sensor 110 (pushbutton) is physically activated. The use of dedicated trigger devices allows for the design, manufacture and sale of low cost devices that can be purchased and implemented for widespread use by end customers. In example embodiments, the trigger device 100 is configured to operate as either a Bluetooth peripheral device or a Bluetooth broadcaster device.

Figure 3:
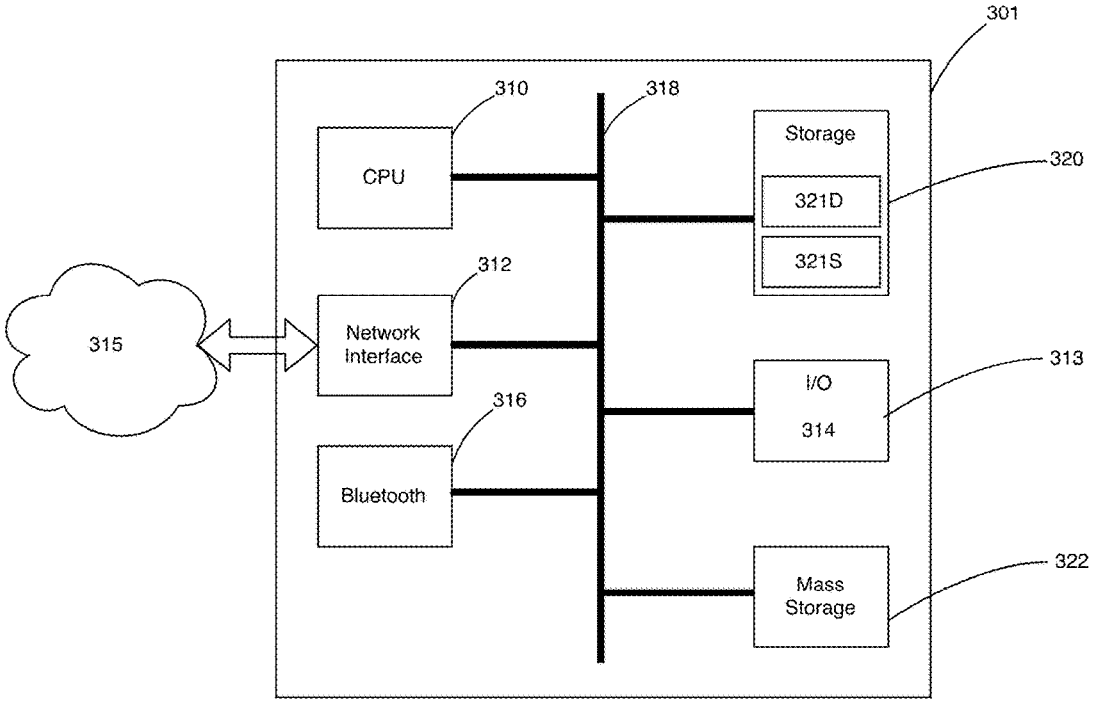
FIG. 3 is a block diagram of a user device of the system of FIG. 1.

FIG. 3 is a block diagram of a processing system 301 that may be used to implement user device 300. Specific devices may utilize all of the components shown, additional components that are not shown, or only a subset of the components and levels of integration may vary from device to device. Furthermore, a device may contain multiple instances of a component, such as multiple processing units, processors, memories, transmitters, receivers, etc. The device 300 may comprise a one or more input/output devices, such as a speaker, microphone, mouse, touchscreen, keypad, keyboard, printer, display, and the like. The processing system 301 may include a central processing unit (CPU) 310, transient and non transient memory 320, a network interface 312, an I/O interface 314, and low energy Bluetooth radio 316 (with antenna circuit) connected to a bus 318.

The bus 318 may be one or more of any type of several bus architectures including a memory bus or memory controller, a peripheral bus, video bus, or the like. The CPU 310 may comprise any type of electronic data processor. The memory 320 may comprise any type of system memory such as static random access memory (SRAM), dynamic random access memory (DRAM), synchronous DRAM (SDRAM), read-only memory (ROM), a combination thereof, or the like. In an embodiment, the memory 320 may include ROM for use at boot-up, and DRAM for program and data storage for use while executing programs.

The I/O interface 314 may provide interfaces to couple input and output devices to the bus 318. Examples of input and output devices may include a display (with or without touch screen capability), a mouse, touchpad, speaker, microphone, accelerometer and keyboard.

The network interface 312 may allow the device 300 to communicate via one or more networks 315, which may include wired and wireless communications links. In an embodiment, the network interface 312 provides access to a wireless wide area network (WAN) and/or to a cellular network, such as Long Term Evolution (LTE), Code Division Multiple Access (CDMA), Wideband CDMA (WCDMA), and Global System for Mobile Communications (GSM) networks, and to WiFi networks. In an embodiment, the device 300 is coupled to a local-area network or a wide-area network for data processing and communications with remote devices, such as other processing units, the Internet, remote storage facilities, or the like.

In the illustrated embodiment, Bluetooth radio 316 allows mobile device 300 to communicate with trigger devices 100 as will be explained in greater detail below. In example embodiments, the trigger device 100 is configured to operate as a Bluetooth central device or Bluetooth observer device.

In example embodiments, device 300 includes applications stored in memory 320 that provide instructions for the CPU 310 to enable to device 300 to perform its intended functions. Such applications may be preloaded on the device 300 or downloaded to the device through one or more of the device interfaces. In an example embodiment these applications include notification application 321D that configures the device 300 to perform the user device-side functions described herein that relate to notification system 100.

User device 300 may for example take the form of a smart phone, tablet computer or other mobile communications device, or could be a stationary user computer.

In example embodiments, remote server 200 and notification servers 400 could have an internal processing system 301 similar to that shown in FIG. 3, however such servers may also include mass storage devices 322 and may not include Bluetooth radio 316. In an example embodiment, remote server 200 also includes an application 321S that configures the remote server 200 to perform the server-side functions described herein that relate to notification system 100.

Figure 4:
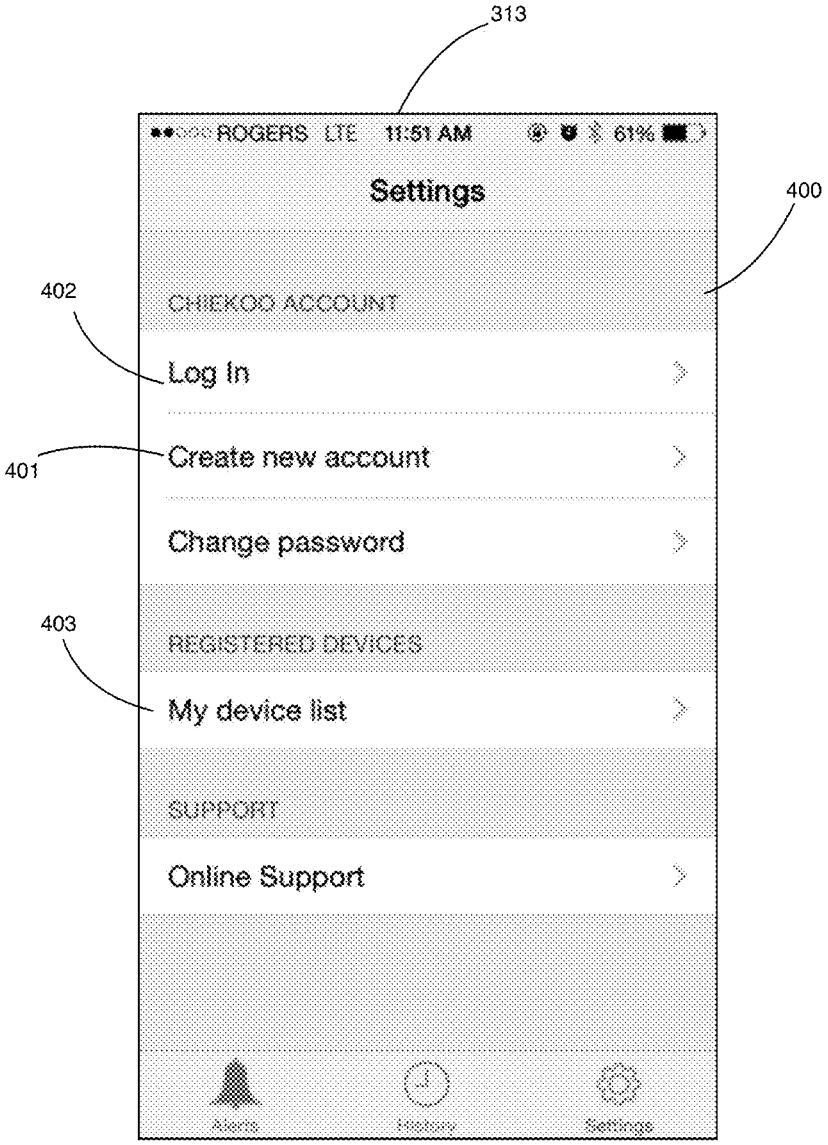
FIGS. 4 to 12 show sample screen shots of user interface screens displayed on user devices during a registration procedure of the system of FIG. 1.

In example embodiments, trigger devices 100 are each associated with a unique user group 210 that is tracked and maintained as user group data 212 by remote server 200. Each user group 210 for a trigger device 100 includes subscribers that includes an owner mobile device 300-O and typically will also include a plurality of follower mobile devices 300-F. An example of creating a user group for a trigger device 100 will now be described according to example embodiments with reference to FIGS. 1-3 and sample user interface screens shown in FIGS. 4-12. The user interface screens in FIGS. 4-12 illustrate interactive displays that are shown on the display screen 313 of devices 300, which in the presently described embodiment is a touch screen. In this regard, FIG. 4 shows a "settings" user interface 400 that is generated on screen 313 of user device 300 by application 321D. The settings user interface 400 allows a user of the device 300 to cause the device 300-O to interact over network 315 with remote server 200 to subscribe to one or more trigger devices 100.

As an initial step, the device user is required to set up a "Notification System Account". Any number of different procedures can be used to set up an account—in the illustrated embodiment interface screen 400 includes a user selectable "Create New Account" option 401. In response to user selection of "Create New Account" option 401, the device 300 displays the user interface screen 550 (FIG. 5) which prompts the user to enter account creation particulars, including for example an email address (which functions as a unique user account identifier as well as a communications address) and a password. After a user enters the required information and selects a "submit" or "save" action, the device 300 is configured to provide the user provided information, along with a unique user device identifier for device 300, to remote server 200 over the network 315.

Figure 5:
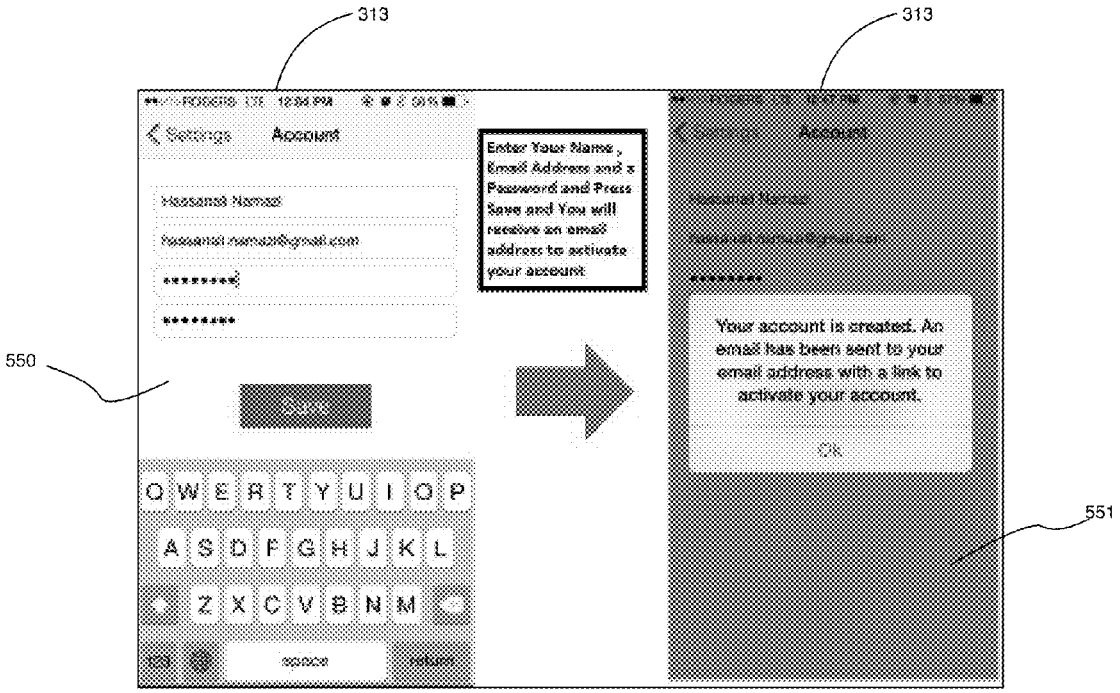
Figure 6:
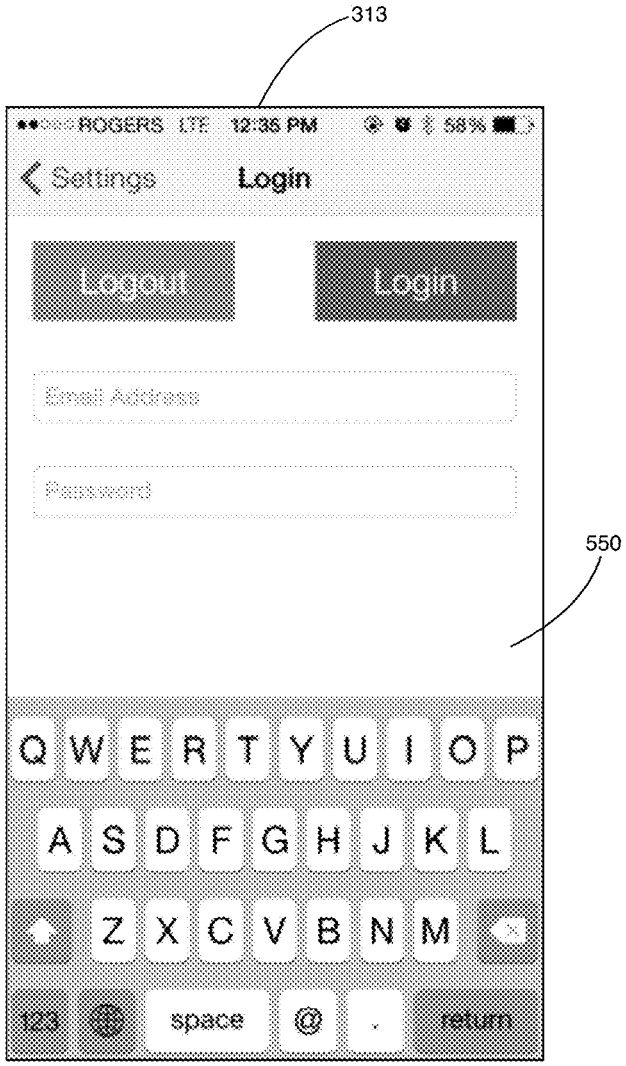
Figure 7:
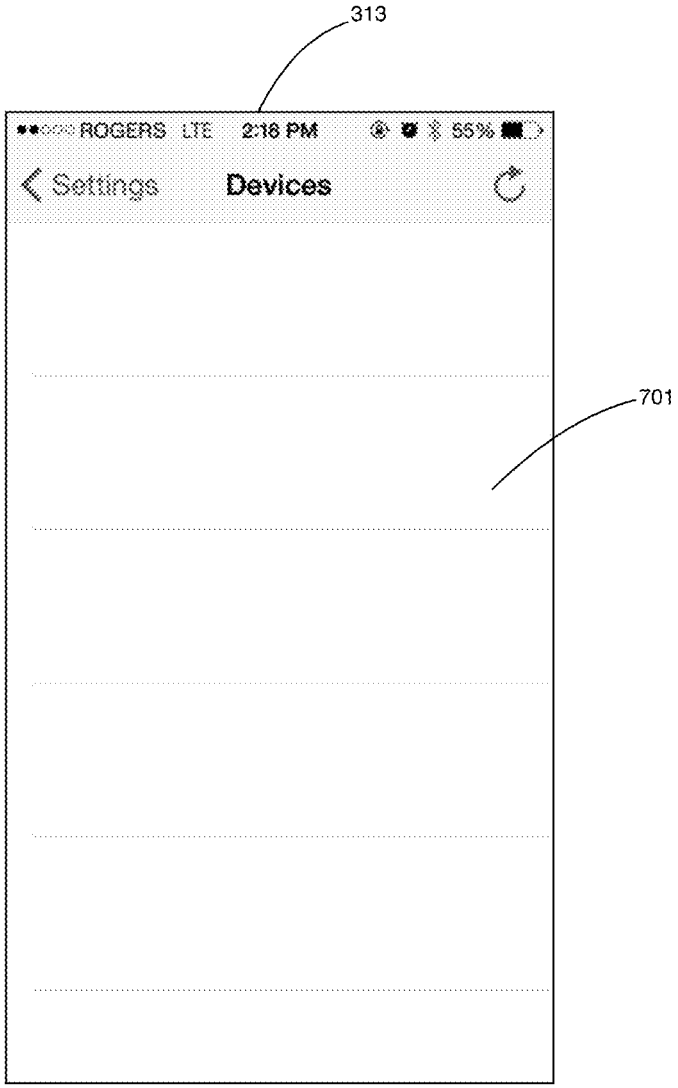
Figure 8:
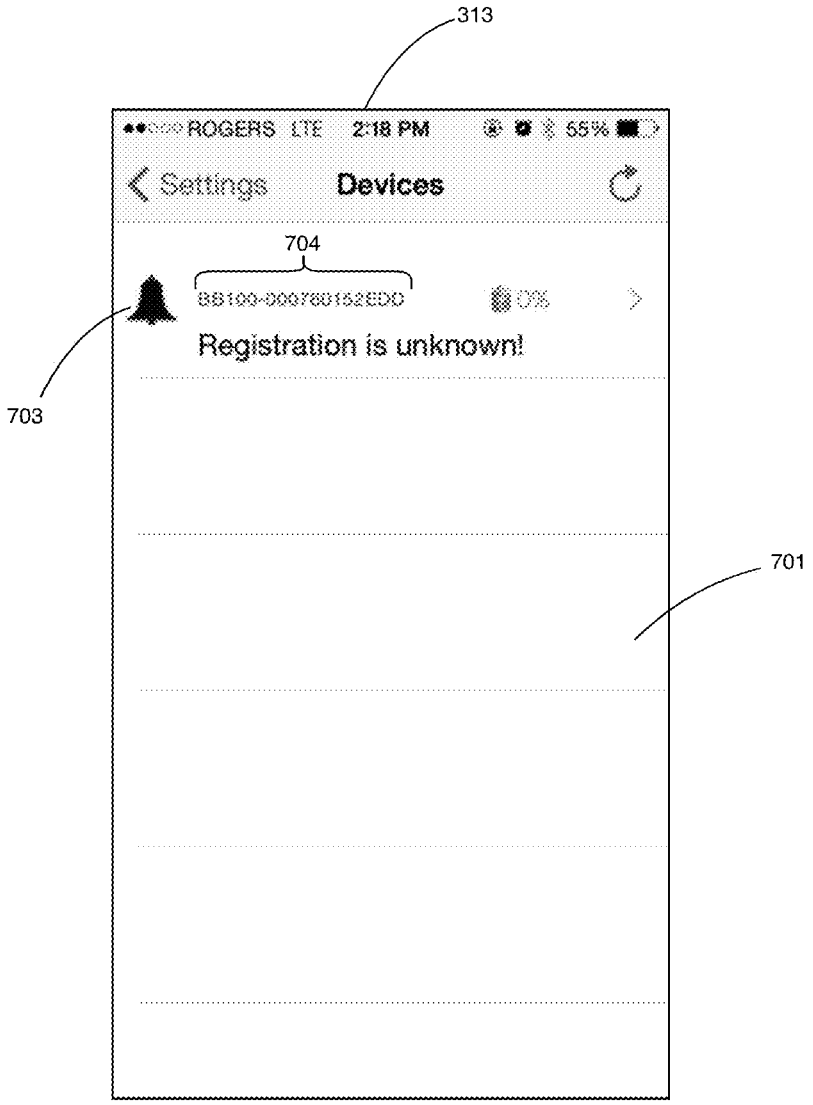

When remote server 200 receives the request it creates and stores a user account record that includes the provided information for the newly created account. The remote server 200 then sends an email message to the user's email address that includes an authentication link. On the device side, as shown in FIG. 5, after sending the data to server 200, the device then displays interface screen 551 prompting the user to access the email message from the server 200 and click the provided link to allow the server 200 to authenticate the account. Once the user has received the email message and clicked on the link, they can return to user interface 400 and select the "log in" option 402, which causes device 300 to display a "login" interface shown in FIG. 6 that prompts the user to provide a user identifier (email address in the illustrated example) and password. The device 300 provides the login information to server 200 which authenticates the login and advises device 300 accordingly, which then returns to interface 400. Interface screen 400 includes a user selectable option "My device list" 403. When the "My device list" option is selected by a user, device 300 displays as device list interface 701 as shown in FIG. 7. Interface 701 lists trigger devices 100 that the device 300 is registered as a subscriber with. (FIG. 7 illustrating an empty list as the device 300 is not yet registered with any user groups). In example embodiments, while the device 300 is displaying the device interface 701, the device enters a registration mode in which it detects Bluetooth advertising packets sent by trigger devices 100 that the device 300 is in Bluetooth range of but not registered with, and displays an identification record for any such trigger devices 100. By way of example, FIG. 8 shows an identification record 703 displayed on screen for a trigger device 100 that device 300 is not registered with. The ID record 703 includes a trigger device type identifier in the form of a "bell" icon, and a unique trigger device identifier 704 ("BB100-00780152EDD" in the illustrated embodiment, which is a combination of information from the MAC address for the device 100 and a device model number). The device user can select the displayed ID record 703 to register with the trigger device 100.

Figure 9:
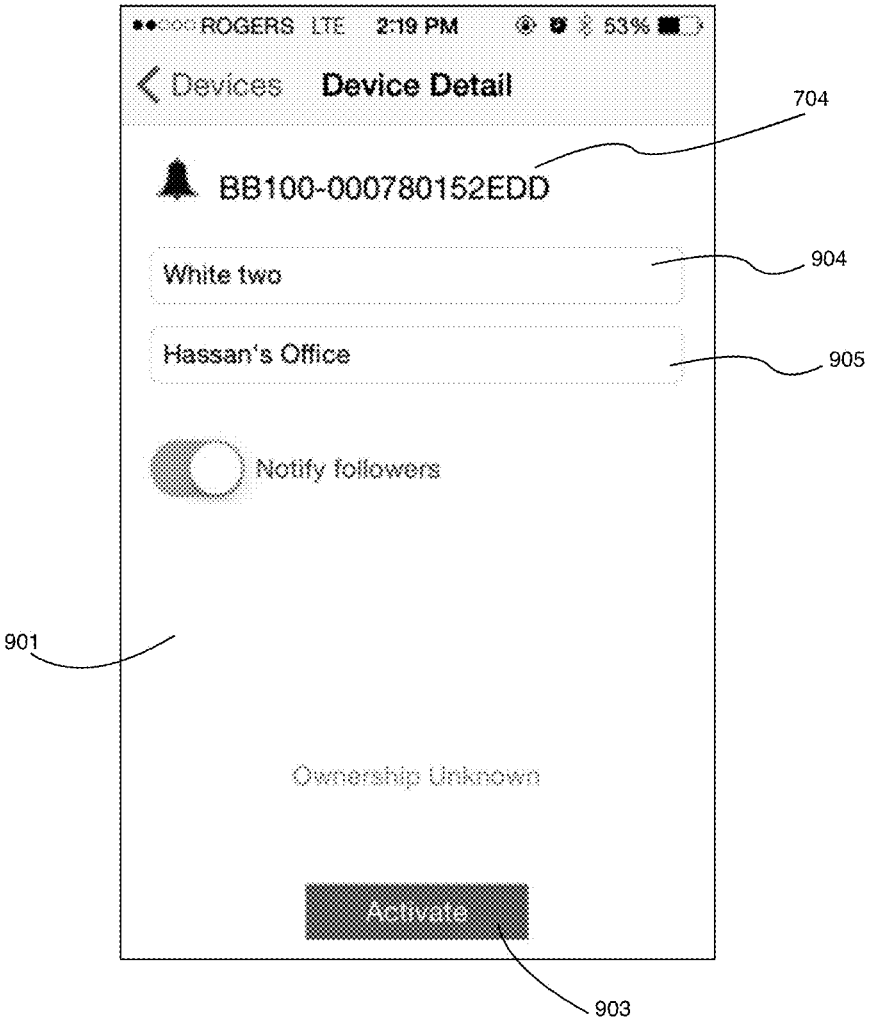

Once a user selects the displayed ID record 703, device 300 sends an information request over network 315 to server 200 that includes ID information for both device 300 and the trigger device 100. Server 200 responds over network 315 with additional information about the trigger device 100 that indicates whether trigger device 100 is registered with the server and "owned" by a user or not. As shown in FIG. 9, in the event that server 200 reports that the trigger device 100 is not yet registered with the server and hence does not have a registered owner, then the device 300 will display a registration interface 901 that includes a "activate" option 903. In at least some embodiments, the registration interface 901 includes one or more device name fields 904, 905 that the device 300 user can use to provide information about trigger device 100. In one example, the first name field 904 is a global device name that the owner sets for the trigger device 100 ("white two" in the illustrated embodiment) the second name field 905 is a user specific name that the user of device 300 can set for the trigger device 100 ("Hassan's Office" in the illustrated embodiment). If the user selects the "activate" option, the device 300 transmits an activate device request over network 315 to remote server 200. The activate device request sent from the owner device 300-O will include identification information for the trigger device 100 and the owner device 300-O, as well as the user supplied information from field's 904 and 905. Remote server 200 registers the device 100, which includes creating a user group data record 212 for the trigger device 100 and registering the user of owner device 300-O as the owner of the user group 210 associated with the trigger device 100. In at least some embodiments, server 200 will send a confirmation back to owner device 300-O through network 315 confirming successful registration.

Figure 10:
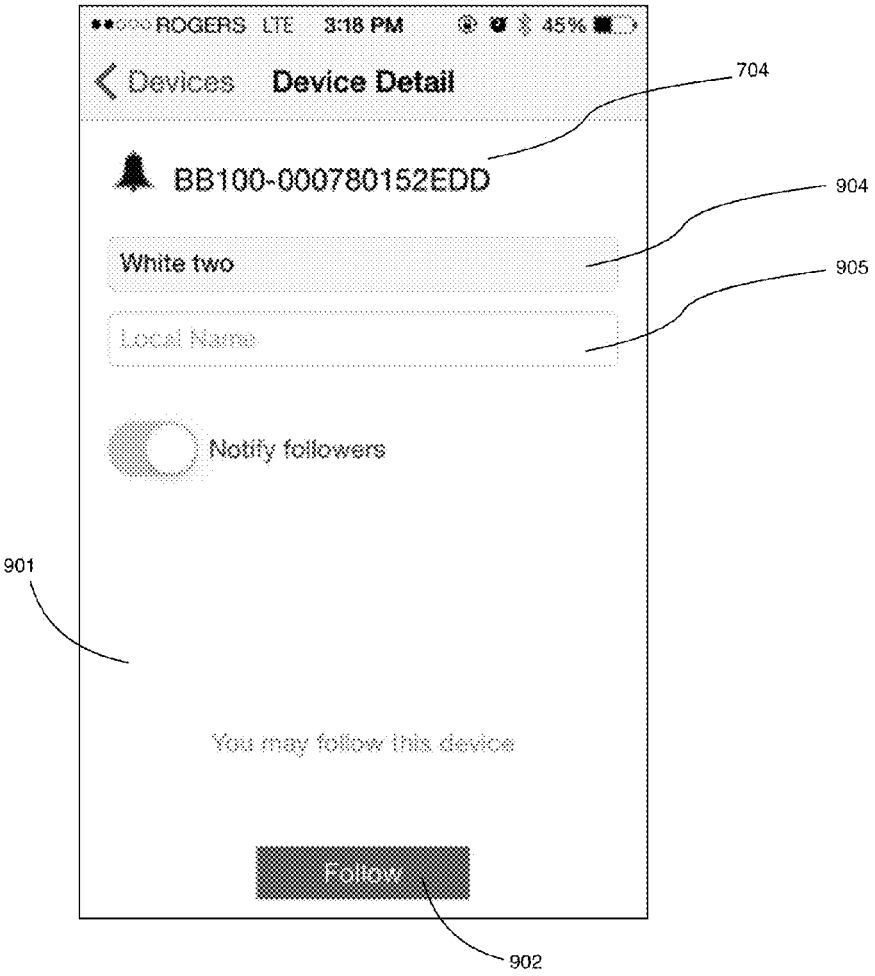

Returning to FIG. 8, if a user selects the displayed ID record 703 for a trigger device 100 that is already registered, device 300-F sends an information request over network 315 to server 200 that includes ID information for both device 300 and the trigger device 100. Server 200 responds over network 315 with additional information about the owned trigger device 100, which may for example include information previously provided by the trigger device registered owner in the owner defined name field 904. As seen in FIG. 10, for an "owned" trigger device 100, registration interface 901 only presents the user with a "follow" option 902 in registration interface 901, and may display the corresponding trigger device name information as retrieved from server 200 in field 904. The user can supply their own name for the trigger device in name field 905. If the user selects the "follow" option 902, the device 300 transmits a follow request message over network 315 to server 200. In at least some example embodiments the registered owner of a trigger device 100 must approve "follow" requests from other users. In such embodiments, once the server 200 receives a follow request from a follower device 300-F the server 200 will send a follower approval request email to the email address specified in user group data 212 for the registered owner of the trigger device 100. The approval request email will include a link to an interface that identifies the trigger device and the user who has submitted the follow request, allowing the owner the option to approve or reject the follow request. If the follow request is approved, the user device 300-F is registered as a follower in the user group data 212 for trigger device 100 at remote server 200.

Figure 11:
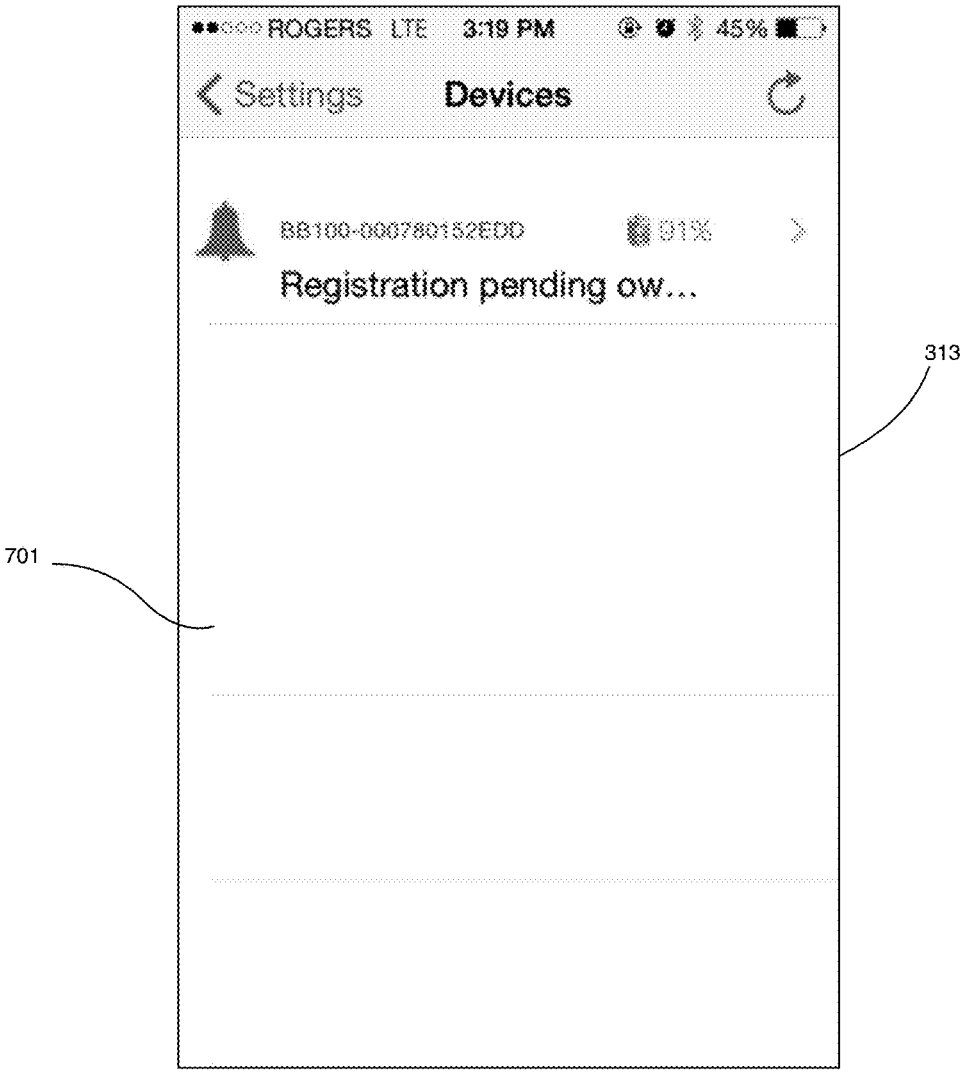
Figure 12:
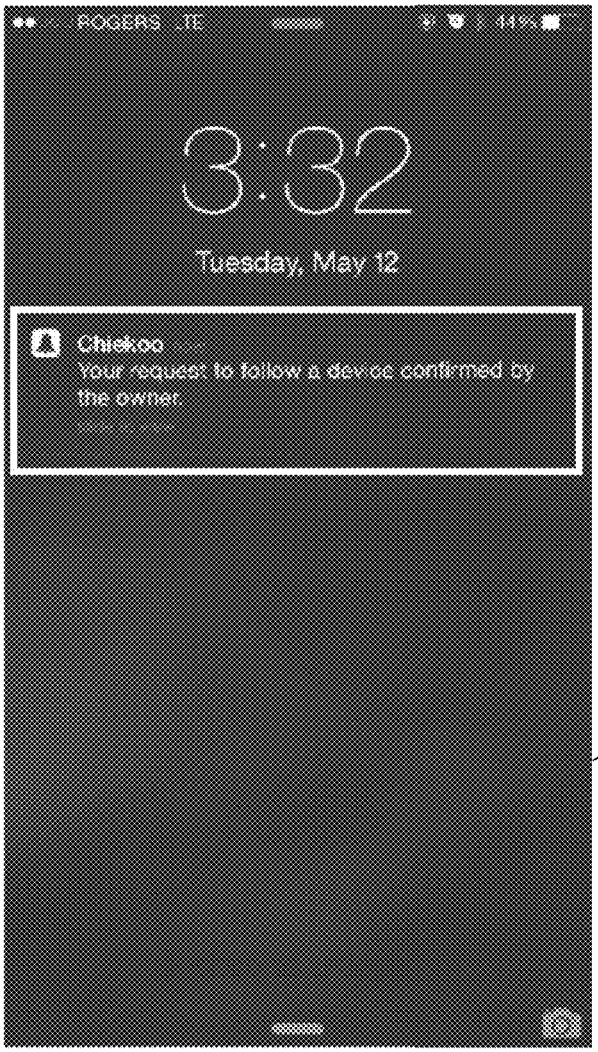

As shown in FIG. 11, once a follow request has been submitted, the user device list interface 701 on the device 300-F from which the follow request has been made will display a notice for the trigger device 100 indicating "Registration Pending Owner Approval". As shown in FIG. 12, once a follow request has been approved, the follower device 300-F will receive a remote notification message from server 200 indicating that the follow request has been approved.

Each user device 300-O/300-F stores a local list of trigger devices 100 that the device is registered with as an owner or follower that is used to populate the Device List interface 701.

Operation of notification system 90 according to example embodiments will now be described in greater detail. As noted above, in example embodiments, the trigger device 100 of the alert notification system 90 is equipped with a Bluetooth low energy radio 120 that acts as a Bluetooth peripheral or broadcaster. The trigger device 100 includes one or more trigger elements 110 that are electrically connected to a microcontroller (MCU) 121 of the trigger device 100. The trigger elements 110 may for example be elements that are activated mechanically, magnetically or by other means. Once the trigger element 110 of a trigger device 100 is activated, the trigger device starts broadcasting for a predetermined time (Alert Period) of short duration, and goes back to inactive state till the trigger element 110 is activated again. The trigger device 100 can transmit short data packets to a coverage area 150 and, if configured as a peripheral, also receive short data packets. In example embodiments, the information broadcast by the trigger device 100 takes the form of short advertising data packets 500 (see FIG. 1) that are provisioned in the core Bluetooth Low Energy BLE standard, a format which conserves energy and also make it possible for a central device (e.g. User device 300) scanning for Bluetooth low energy peripherals (e.g. trigger device 100) to uniquely identify a trigger device 100. As noted above, in example embodiments, the user device 300 is a mobile device such as a smart phone or a tablet or other device equipped with a Bluetooth low energy radio 316 and provisioned with an application 321D that configures the device to operate according to the methods set out in this disclosure.

Figure 13:
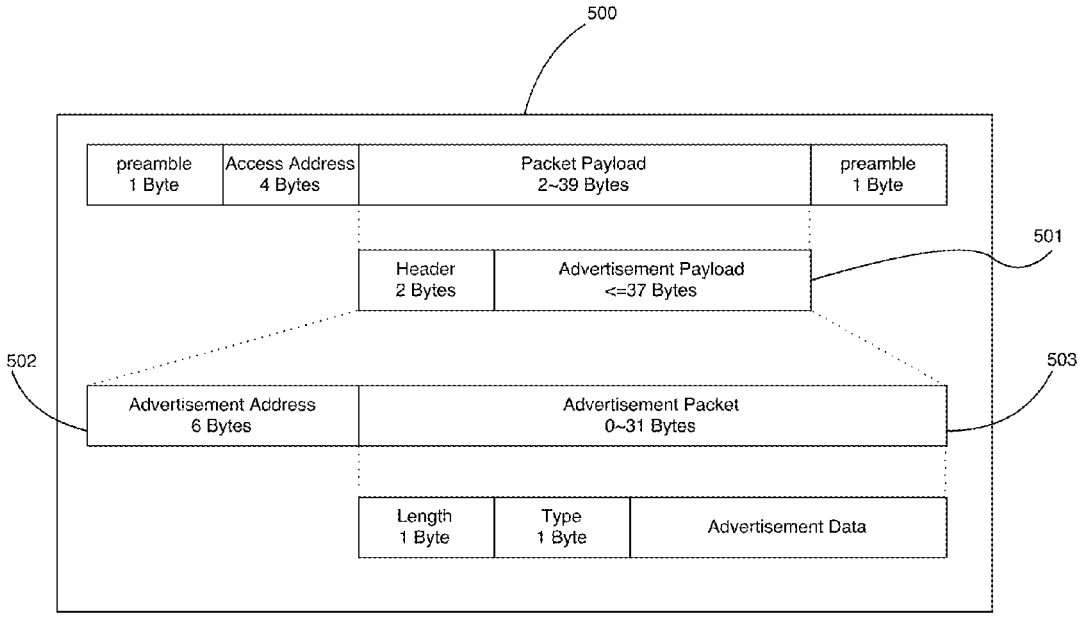

As noted above, each trigger device 100 is identified uniquely by a device identifier 704. The device identifier 704 can be the peripheral local name. In example embodiments, a group of trigger devices can also share an identifier [chiekoo bell, chiekoo charm, . . . Etc.] (unique shared identifier 705), which for example may be limited to 16 bytes in length. In example embodiments, the trigger device 100 always broadcasts its shared unique identifier 705 and device identifier 704 when it is triggered as part of advertising packet transmissions. In this regard, FIG. 13 shows a typical Bluetooth Low Energy transmission advertising packet 500 that can be sent on 3 open 2.4 GHz ISM frequency bands (channel 37, 38 and 39). Packet 500 include an embedded advertisement payload 501 that includes an advertisement MAC address 502 and an advertisement packet 503. FIG. 14 shows advertisement packet examples 503-1, 503-2 that illustrate how a trigger device 100 prepares and transmits advertisement packets for transmitting the share identifier 705, device identifier 704 and custom data 706. When activated, trigger device 100 transmits successively transmits advertisement packets 503-1 and 503-2 to coverage area 150 for a predetermined notification duration. Packet 503-1 contains the device identifier 704; packet 503-2 includes the shared identifier 705 and custom device data 706. In example embodiments, custom device data 706 may indicate the type of class of trigger device 100 (for example, a "doorbell" type, motion sensor type, heat sensor, etc.) and status information such as remaining battery charge for the device 100.

In an example embodiment, the unique device identifier 704, shared ID 705 and custom data 706 used for each trigger device 100 is configured when the device is being assembled and provided prior to device deployment to the database maintained by remoter server 200. In one example, the unique device identifier 704 is formed from a combination of a selected part of the MAC address 502 for the trigger device 100 and part or all of a model number for the trigger device 100. In some embodiments where a trigger device 100 includes multiple trigger elements 110, the trigger device 100 may have plurality of unique device identifiers 704 each corresponding to a specific trigger element 110 such that user devices 300 can distinguish which trigger element has been activated. In some examples, a trigger device 100 may have only one unique device identifier 704, with trigger element specific information included in custom device data 706.

In some example embodiments, the MAC advertisement address 502 may be used as the unique device identifier—however some user devices 300 may be configured by the device operating system to hide the MAC address 502, in which case use of the actual advertisement packet data space 503 as described above to send a device readable unique trigger device identified provides an efficient solution. By way of example, Apple iOS, at the time of writing this disclosure, hides the address field 502 from high level applications. Accordingly, in at least some example embodiments, the trigger device 100 does not rely on the MAC address as described in BLE transmission protocol to identify a trigger device 100 directly but instead sends a unique identifier 704 in the advertisement packet 503. In some examples, the device unique identifier 704 is the long name of the device 100 identified by standard byte "0x09" ("Type Local Name") or shortened name of the device identified by standard byte "0x08" in a Bluetooth advertisement packet.

As noted above, in example embodiments a trigger device 100 will transmit alert notifications 500 in the form of bursts of two successive advertisement packets 503-1, 503-2 when trigger element 110 is activated, one packet including unique device identifier 704, and the other packet including the shared identifier 705. In example embodiments the shared identifier 705 is used to distinguish peripheral or broadcast devices that are part of or intended to be part of notification system 90 from other third party devices. Accordingly, the notification application 321D on device 300 can use the shared identifier to quickly determine if a received advertisement packet can be ignored or must be processed further.

Figure 15:
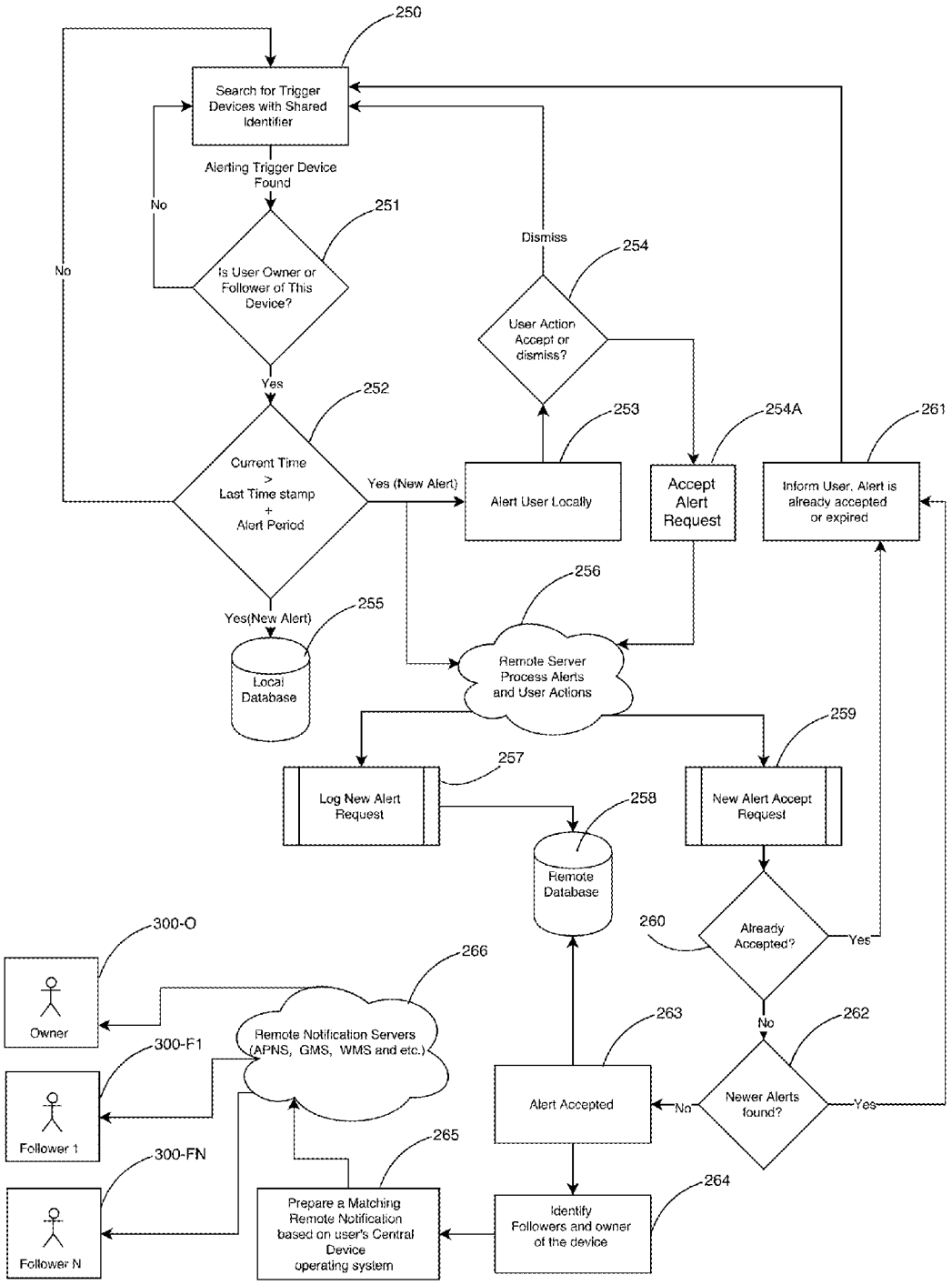
FIG. 15 is a flow diagram illustrating operation of an example embodiment of the system of FIG. 1.

FIG. 15 illustrates processing performed at user device 300 and servers 200 and 400 during operation of notification system 90 according to example embodiments. As indicated at Action 250, when application 321D is running on user device 300 in the background or foreground, the device 300 periodically scans for broadcast Bluetooth advertising packets and assesses, based on shared identifier 705 in any received packet if that packet must be processed further. Thus, the user device 300 uses the shared unique identifier 705 to filter out the broadcasts received from Bluetooth devices and only process broadcasts from trigger devices 100. Such filtering can help conserve energy when the user device 300 is scanning to find a trigger device 100. In the described embodiment, user device 300 can receive advertising packets from a trigger device 100 without pairing or creating a connection to the trigger device 100.

As indicated at Action 251, once a alert notification 500 broadcast from a trigger device 100 with a known shared unique identifier 705 is found, the user device 300 compares the unique device identifier 704 with records saved in a local database or, via network 315, a remote database 212. If a matching record found, the user device 300 then determines, as indicated by Action 252, if the received alert is a new alert or subsequent packets in an already received alert. In this regard, user device 300 compares a time stamp of the received alert packets with the time of the last alert time stamp recorded by device 300 to determine if the differences is less than or greater than a known alert transmission period. If the time difference is outside of the known alert period (i.e. the amount of time that trigger device 100 repeatedly sends packets 503-1, 503-2 for a specific trigger event, which could for example be several seconds to allow a sleeping device to wake up; in at least some example embodiments the alert period is less than one minute), then the user device 300 will determine that it is handling a new alert notification, otherwise the user device 300 will conclude that the alert notification is already being processed. In the event that received alert is determined to be a new alert notification, the user device 300 will record a time stamp and device identifier locally (Action 255) and also send an alert notification over network 315 (Action 256) to remote server 200 which in turn logs the new alert request (Action 257), including updating an alert history record for the trigger device 100 in remote user group database 212 (Action 258). The alert history record at least contains a timestamp, unique trigger device identifier 704 and one or both of a user device identifier for user device 300 or an user account identifier for the person using the device 300 (user device identifier or user account identifier being interchangeably referred to as user identifier in this document).

As noted above, in example embodiments multiple user devices 300 are located within the Bluetooth coverage area 150 of a trigger device 100. Accordingly, for every new alert notification 500, a request to log an alert history record on a remote server 200 (Actions 256, 257, 258) will be initiated by each user device 300 that detects the new alert notification 500. In example embodiments, the remote server 200 compares the last timestamp for the alert received from a particular trigger device 100, identified by its device identifier 704, with current time in the remote server 200. If the difference between the last time stamp and current time is greater than a predetermined alert period then the remote server will log the record with the current time on the server 200 as the time stamp of the record. The remote server 200 continues to log each new alert from different requesting user devices 300 and aggregates these new alerts such that they can be identified together as aggregated new alerts all associated with originating alert notification 500.

Figure 16:
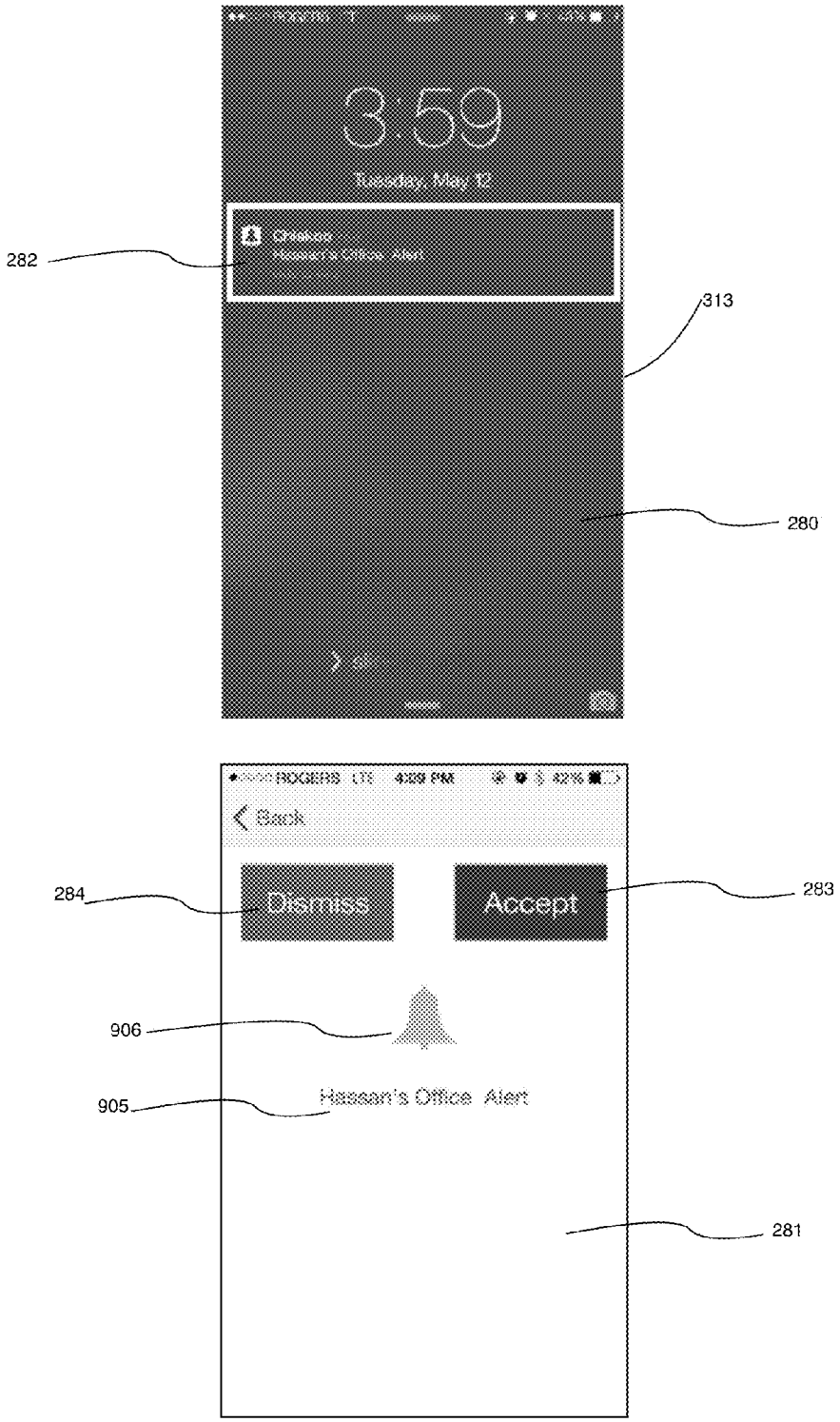
FIGS. 16-19 show examples of user interface screens generated on a user device.
Figure 17:
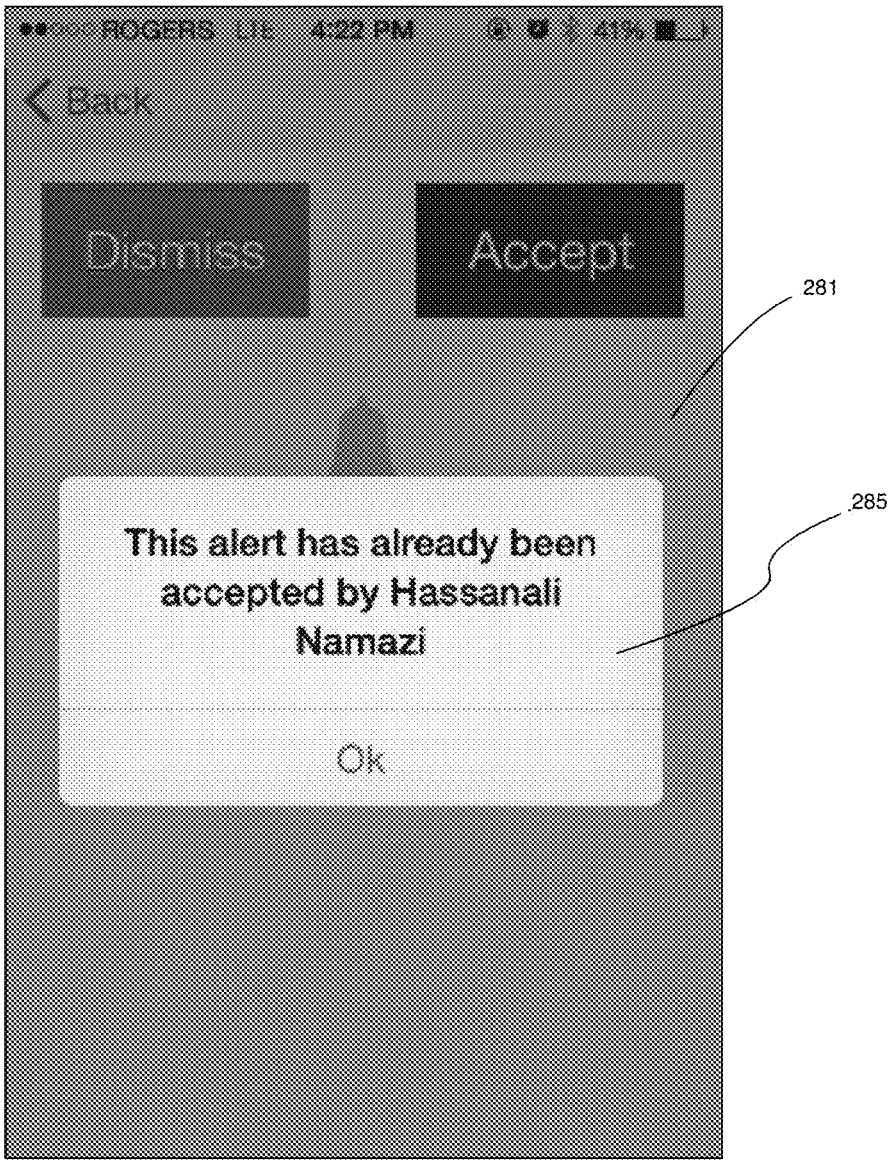

Turning again to the functionality of user devices 300, after detecting a new alert notification as per Action 252, the user device 300 issues a local notification (Action 253) to alert a user of the device of the new notification alert 500. Such an alert can, for example, take the form of one or more of an audible alert, a physical (vibration) alert, or a visible alert. In this regard, FIG. 16 illustrates a user interface 280 in which an alert notification 282 is displayed on the home screen of a locked user device 300 and alert interface 281 illustrates the screen as displayed on an unlocked user device 300, which includes user selectable "Dismiss" and "Accept" options 284, 283, as well as the local name 905 that user has previously stored for the trigger device 100 and a device type indicator 906. As indicated by Action 254, the user of device 300 may accept the alert notification 500 or dismiss it through the user alert interface 281 provisioned on the device 300. Once an alert is accepted by a user, the user device 300 (Action 254A) initiates an "alert acceptance request" message 520 (FIG. 1) over network 315 to remote server 200. Upon receiving the "alert acceptance request" 520 the remote server 200 identifies latest aggregated new alerts on the server that are associated with the alerting trigger device 100 and the particular user identifier (Actions 256, 259) and checks to see if any other user device 300 has already accepted the new alert (Action 260). If a record of such an acceptance is found, the server 200 sends an "alert already accepted" reply message 510 to the user device 300 that sent the alert acceptance request, which then advises its user through one or more of a physical, audible, or visual message that the alert notification 500 has already been accepted by another user (Action 261). In this regard, FIG. 17 illustrates the user interface 281 on a user device 300 in which a dialog box 285 is displayed to inform the device user that another user has already accepted the alert notification. In the illustrated embodiment, the remote server includes an identifier of the accepting user or user device ("Hassanali Namazi") in the "alert already accepted" message so that the user knows who has assumed responsibility for the alert. In the event, however, that no other user has accepted the new alert 500, then the remote server 200 will search to see if other newer alerts exist for the same alerting trigger device 100 (Action 262). If other newer alerts exist, the reply message 510 that the remote server 200 send the requesting user device 300 will indicate that the alert has expired, and user device dialog box 285 will display an corresponding message such as "the alert has expired".

If however, the remote server 200 determines, in response to an "alert acceptance request" 520 that the alert has not been accepted by another user and has not expired, the remote server 200 will assign the alert to the requesting user device 300 with the result that the user acceptance will be logged in database 212 and a reply message 510 to the requesting user device 300 will be sent that advises the device of its acceptance. The user device 300 will in turn inform its user—for example dialog box 285 could include the message "Acceptance of this alert by you is confirmed".

In addition to sending a specific message to the accepting user device, in example embodiments, the remote server 200 may also send remote notification to inform all other users—owner and followers—of trigger device 100 that the alert 500 has been accepted by a user (Actions 264, 265 and 266). In order to inform all other users—owner and followers—that alert 500 has been accepted, alert acceptance notification messages 530 are prepared by the remote server 200 for each of the user devices 300-O, 300F that are identified as part of the user group for the trigger device 100. In some example embodiments the alert acceptance notifications are only generated for user devices 300 in the user group that originally advised the server 200 that they received the corresponding alert message 500. Each alert acceptance notification message 530 includes information identifying the trigger device 100, a user identifier to identify the intended recipient, and may also include the user identifier for the accepting device. The structure and delivery method used for acceptance notification message 530 may vary depending on type of operating system installed on the receiving user device 300. For example if the operating system is the Apple iOS™ then remote server 200 prepares acceptance notification message 530 as a data packet that is then sent over network 315 to an Apple remote notification server 400 which in turn will send (push) the packet 540 to the end user device 300 over network 315 using a remote notification protocol (Action 266). The notification messages 530 sent by the remote server 200 to matching operating system remote notification servers 400 will reach the intended recipient user devices as long as such users are signed up for such notifications with their corresponding remote notification server 400. This sign up will be performed by the application 321D on the user device 300 at least once before using the system 90.

Figure 18:
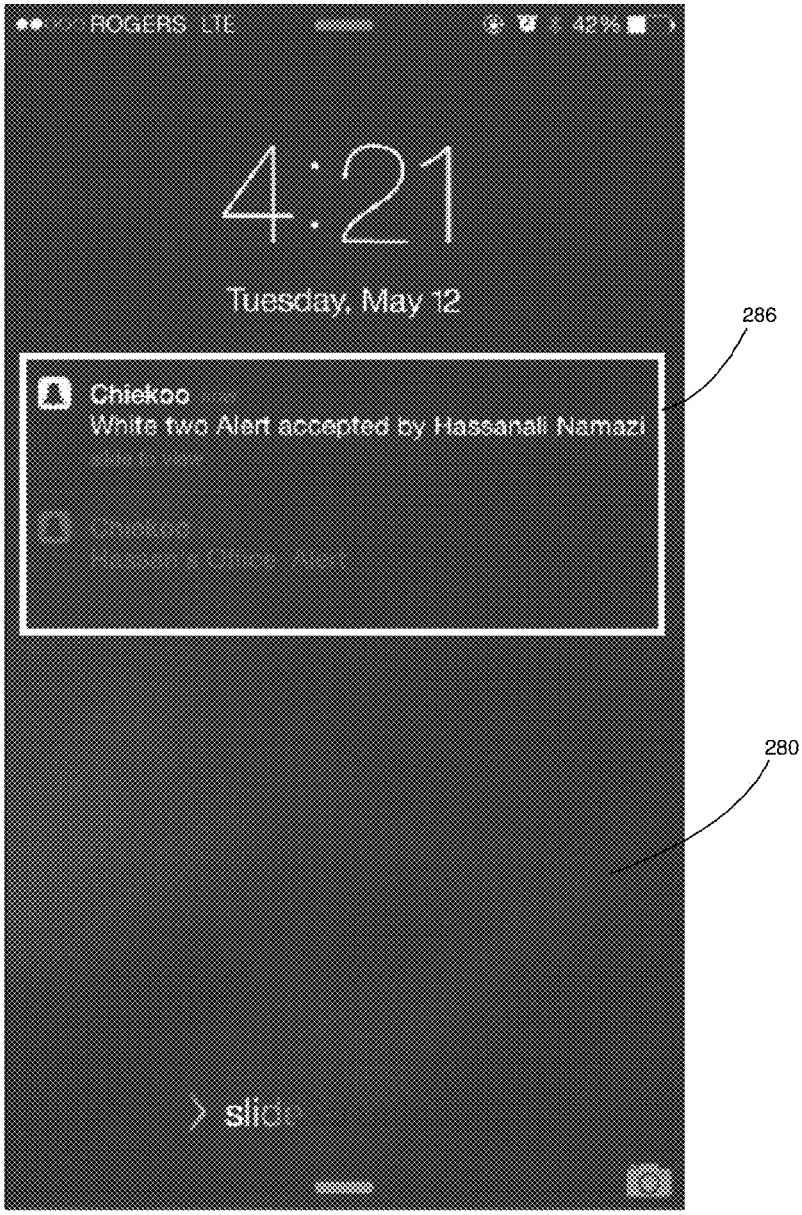

FIG. 18 shows user interface 280 on a device 300 displaying a message 286 after the device 300 receives notification through remote notification server 400 that an alert has been accepted. The message could be accompanied by or replaced with one or more of an audible or vibrational indicator. In the illustrated example, the information received from server 400 and stored locally at device 300 is sufficient to allow the device 300 to display the identity and type of the trigger device 100 as well as the identity of the user who accepted the alert.

Figure 19:
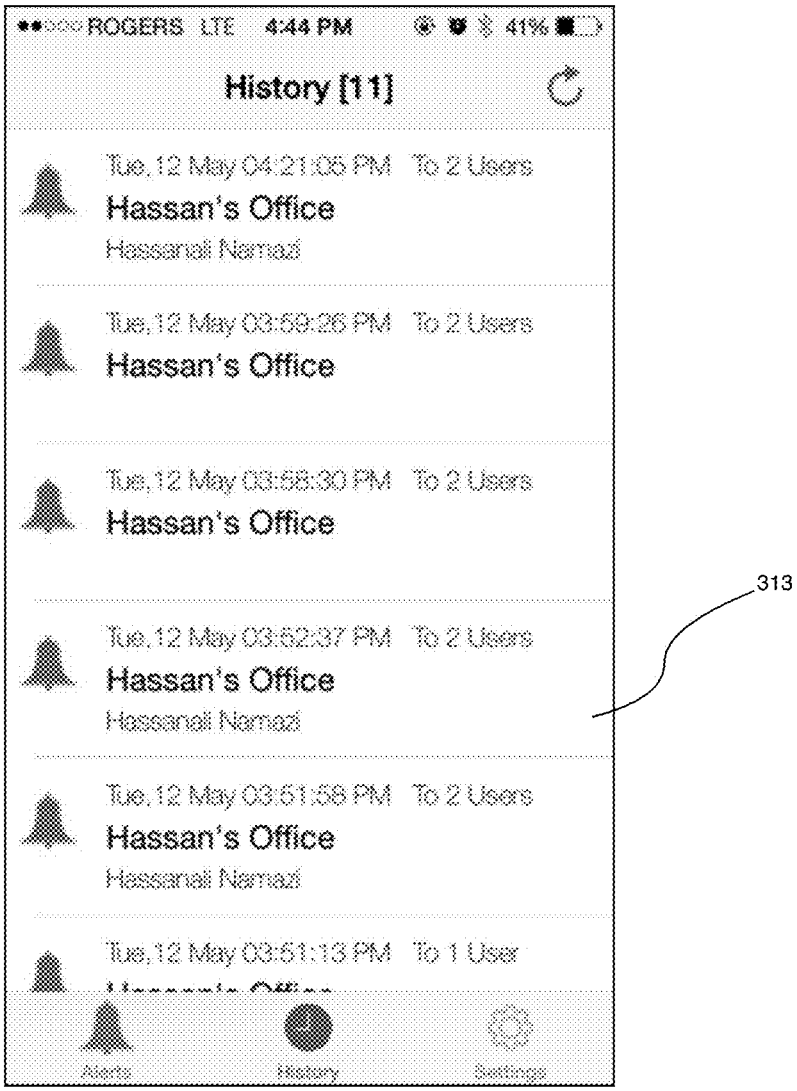

In example embodiments, the device application 321D maintains a log of all alerts received by the device 300 and who has accepted the alerts. In this regard, FIG. 19 shows an example of an "alert history" user interface generated on device screen 313 by device application 321D. A similar log can be maintained at remote server 200. In example embodiments, the alert log is processed to generate productivity reports that identify metrics such as the volume of alerts accepted by each user and the amount of time taken to accept new alerts.

In some example embodiments, alert acceptance notifications 530 may be sent directly to devices 300 rather than through notification servers 400.

An example application of alert notification system will be described with reference to FIG. 20, in which a physical enterprise location is illustrated by box 2000. In an example embodiment, location 2000 may be a big box retail store that is divided into a plurality of N zones, with each zone being assigned a respective trigger device 100-1 to 100-N, with each trigger device 100-1 to 100-N having a push button trigger element 110 and a Bluetooth transmission range that corresponds generally to the location 2000. The trigger devices 100-1 to 100-N are inexpensive dedicated Bluetooth peripheral or broadcast devices that have been provided by the entity that maintains remote server 200. A store administrator has provisioned her or his personal smart phone (user device) 300-O with application 321D and registered with remote server 200 as the owner of trigger devices 100-1 to 100-N. As new employees join, their personal smart phones (user devices) 300-F1 to 300-Fn are respectively provisioned with application 321D and following approval by the store administrator the employees are registered with remote server 200 as followers for the user groups associated with trigger devices 100-1 to 100-N, providing a notification network 90 that has low set up costs from the perspective of the employer. In some examples, employees may be provided with user devices 300 rather than using their own devices.

Figure 20:
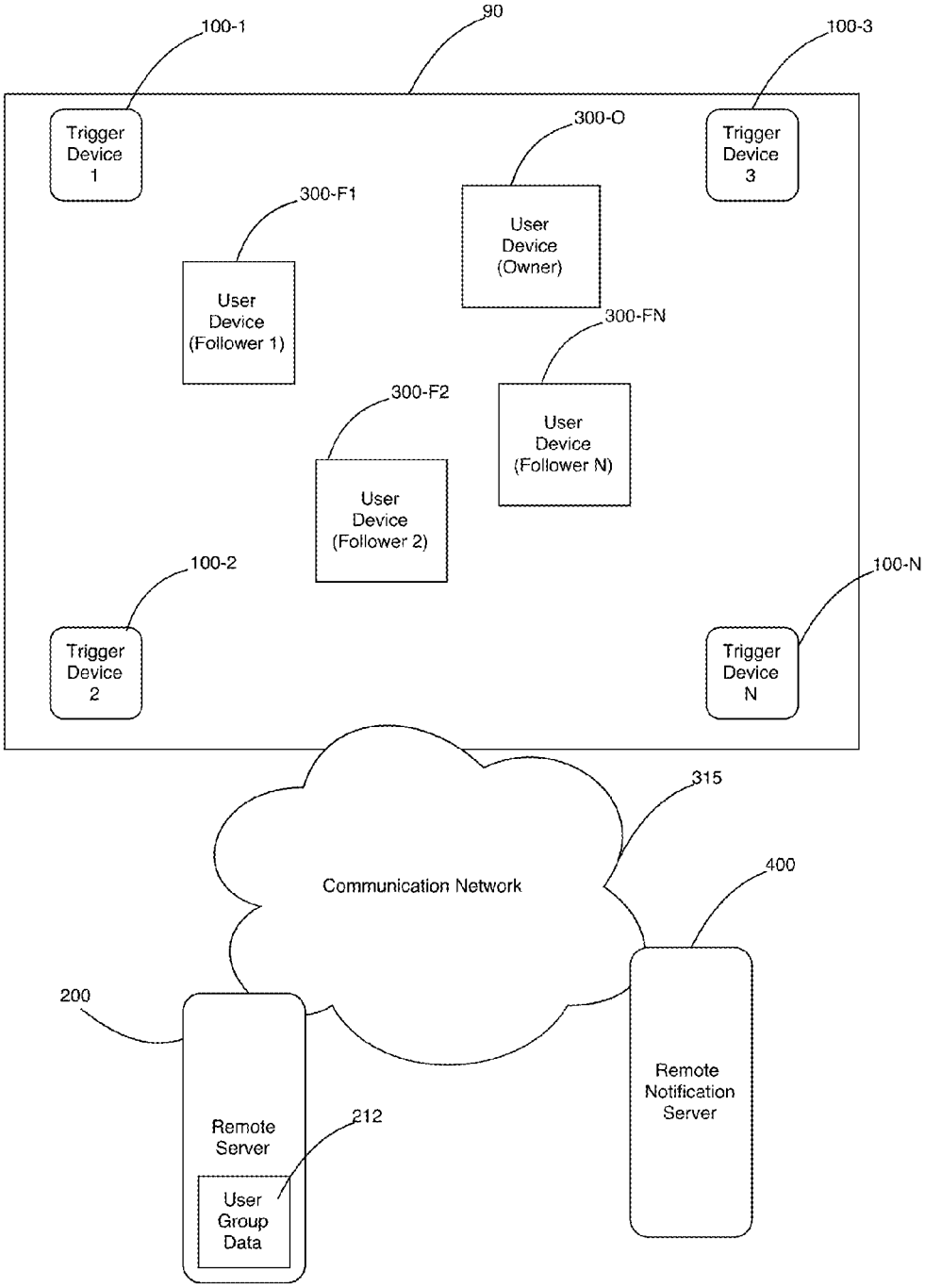
FIG. 20 is a schematic representation of an example implementation of a notification system according to example embodiments.

In the embodiment of FIG. 20, when a customer requires service in one of the store zones (for example Zone I, where N=>i>=1) the customer presses the button of trigger element 110 on the trigger device 100-*i*, which then broadcasts a alert 500 in the form of an advertising packet that includes shared identifier 705 and unique trigger device identifier 704. The user devices 300-O and 300-F1 to 300-Fn located in location 2000 each receive the broadcast and determine that the alert 500 requires further processing based on the shared identifier 705. The alert receiving user devices 300-O and 300-F1 to 300-Fn each then extract trigger device type and identity information from the received advertisement packet 500 to each determine that they are a follower or owner (i.e. part of the device user group) for the trigger device 100-I, and confirm that the alert is a new alert, after which each of the devices 300-O and 300-F1 to 300-Fn send a new alert notification message to remote server 200 and generate a new alert notification for the device user, which may for example be in the form of an audible sound and an onscreen message ("Zone-i assistance request"). Once one of the users of a device 300-O, 300-F1 to 300-Fn accepts the assistance request the accepting user device sends an acceptance request message 520 to remote server 200 which confirms that the alert 500 is a new alert that has not yet been accepted by any other user. The remote server 200 logs that the alert 500 has been accepted, the identity of the accepting party, and the time duration between when the server originally became aware of the new alert and when the alert was finally accepted by the accepting user. A alert acceptance confirmation message is sent by the server back to the accepting user device 300, and the remote server generates alert acceptance notification messages 530 for each of the user devices 300-O, 300-F1 to 300-Fn that originally indicated that they had received the alert 500. The acceptance notification messages 530 are pushed to the respective user devices 300-O, 300-F1 to 300-Fn via notifications servers 400 that the devices are respectively associated with.

In some examples location 2000 is a establishment with change rooms and trigger devices 100 can be used by change room occupants to summon a change room attendant. In some examples location 2000 is a restaurant and trigger devices 100 can be used by diners to call a server to their table. In some examples location 2000 is a stadium or entertainment venue and trigger devices 100 can be used by customers to call a server to their location. In some examples location 2000 is a health care facility and trigger devices 100 can be used by residents or patients to call personnel server to their location. In some examples location 2000 is a residence and trigger devices 100 can be used as door bells, with the residents using their smart phones as user devices 300. In some example embodiments, the trigger elements 110 include motion sensors.

The information logged at server 200 can be periodically used to determine employee performance and customer service metrics. In some example's additional alerts could be provided so that server 200 automatically notifies owner user device 200 if services thresholds are not being met—for example when new alerts are not claimed by any user for a predetermined duration, or if some users are logged as responding to too few or too many alerts within predefined durations.

While the present disclosure is described, at least in part, in terms of methods, a person of ordinary skill in the art will understand that the present disclosure is also directed to the various components for performing at least some of the aspects and features of the described methods, be it by way of hardware components, software or any combination of the two. Accordingly, the technical solution of the present disclosure may be embodied in the form of a software product. A suitable software product may be stored in a pre-recorded storage device or other similar non-volatile or non-transitory computer readable medium, including DVDs, CD-ROMs, USB flash disk, a removable hard disk, or other storage media, for example. The software product includes instructions tangibly stored thereon that enable a processing device (e.g., a personal computer, a server, or a network device) to execute examples of the methods disclosed herein.

The present disclosure may be embodied in other specific forms without departing from the subject matter of the claims. The described example embodiments are to be considered in all respects as being only illustrative and not restrictive. Selected features from one or more of the above-described embodiments may be combined to create alternative embodiments not explicitly described, features suitable for such combinations being understood within the scope of this disclosure.

All values and sub-ranges within disclosed ranges are also disclosed. Also, while the systems, devices and processes disclosed and shown herein may comprise a specific number of elements/components, the systems, devices and assemblies could be modified to include additional or fewer of such elements/components. For example, while any of the elements/components disclosed may be referenced as being singular, the embodiments disclosed herein could be modified to include a plurality of such elements/components. The subject matter described herein intends to cover and embrace all suitable changes in technology.

Certain adaptations and modifications of the described embodiments can be made. Therefore, the above discussed embodiments are considered to be illustrative and not restrictive.

What is claimed is:

1. A multi-device alert notification system comprising:

a trigger device comprising a trigger element and a low energy wireless transmitter for broadcasting an alert message in unlicensed spectrum directly to mobile user devices when the trigger element is activated, the alert message comprising a unique trigger device identifier;

a remote server system storing information that identifies the trigger device, the remote server being configured to:

receive, through a network, an alert notification message from each of a plurality of mobile user devices, each alert notification message indicating that the mobile user device has received the alert message directly from the trigger device through the unlicensed spectrum and including the unique trigger device identifier and a unique user identifier associated with the mobile user device;

receive, through the network, an alert acceptance request message from one of the mobile user devices that includes the unique trigger device identifier and the unique user identifier associated with the mobile user device; and send notification messages to at least the mobile user devices that did not send the alert acceptance request message, the notification messages indicating that the alert message from the trigger device has been accepted by one of the plurality of mobile user devices.

2. The system of claim 1 wherein the trigger device is configured as a Bluetooth™ peripheral or broadcast device and the alert message is sent in the form of Bluetooth compliant advertising packets.

3. The system of claim 2 wherein the unique trigger device identifier is located in an advertising packet data payload section of the advertising packets.

4. The system of claim 3 wherein the unique trigger device identifier is derived from a long name the trigger device as identified by standard byte "0x09" or shortened name of the device identified by standard byte "0x08" in a Bluetooth compliant advertisement packet.

5. The system of claim 1 wherein the notification messages for at least some of the mobile user devices are pushed to the least some of the mobile user devices through a notification server system that receives the notification messages from the remote server system.

6. The system of claim 1 wherein the alert message includes a shared identifier that is common to a plurality of trigger devices and is used to signal to the mobile user devices that the trigger device belongs to a class or group of trigger devices.

7. The system of claim 6 wherein the alert message is sent for a predetermined alert period after the trigger element is activated.

8. The system of claim 7 wherein the alert period is less than one minute.

9. The system of claim 7 wherein the remote server system is configured to associate a plurality of the alert notification messages to the alert message by comparing timing information for the alert notification messages with the predetermined alert period.

10. The system of claim 1 wherein the remote server system maintains user group data identifying registered mobile user devices for the trigger device, the remote server system being configured to register mobile user devices for each trigger device only after receiving approval from a designated owner for the trigger device.

11. The system of claim 1 further comprising the plurality of mobile user devices, wherein each mobile user device includes a receiver for receiving the alert message through the unlicensed spectrum directly from the trigger device, and wherein each mobile user device is configured to generate a user notification when an alert message is received from the trigger device and generate a further user notification when the mobile user device receives the notification message that the alert message from the trigger device has been accepted.

12. The system of claim 11 wherein the mobile user devices are each configured to permit a user to select an option cause the mobile user device to send the alert acceptance request message.

13. The system of claim 1 wherein the remote server system is configured to track performance metrics identifying response times and responding mobile user devices for a plurality of alert messages from the trigger device.

14. The system of claim 1 wherein the trigger device is a dedicated purpose device with the trigger element comprising a sensor or button activated by physical contact.

15. The system of claim 1 wherein the trigger element comprises a presence or motion sensor for detecting the presence or motion of a person.

16. The system of claim 1 comprising a plurality of the trigger devices arranged in associated areas of a retail or service location and the mobile user devices are associated with support persons in the facility, the trigger devices being used to summon one or more of the support persons to their associated areas.

17. A method for notifying multiple devices of a received alert, comprising:

broadcasting, from a trigger device, an alert message over unlicensed radio frequency spectrum directly to mobile user devices when a trigger element of the trigger device is activated, the alert message comprising a unique trigger device identifier;

receiving at a server system, through a network, an alert notification message from each of a plurality of mobile user devices, each alert notification message indicating that the mobile user device has received an alert message from the trigger device and including a unique trigger device identifier and a unique user identifier associated with the mobile user device;

receiving at the server system, through the network, an alert acceptance request message from one of the mobile user devices that includes the unique trigger device identifier and the unique user identifier associated with the mobile user device; and sending, from the server system, notification messages to at least the mobile user devices that did not send the alert acceptance request message, the notification messages indicating that the alert message from the trigger device has been accepted by one of the plurality of mobile user devices.

18. The method of claim 17 wherein the notification messages for at least some of the mobile user devices are pushed to the least some of the mobile user devices through a notification server system that receives the notification messages from the remote server system.

19. A method of processing alert notifications at a mobile user device, comprising:

receiving, in unlicensed spectrum through a low energy wireless receiver, an alert message broadcast from a trigger device, the alert message comprising a unique trigger device identifier;

sending, to a remote server system, a user notification when the alert message is received from the trigger device; and sending, to the remote server system, a further user notification when the mobile user device receives a user input indicating user acceptance of the alert message.

20. A multi-device alert notification system comprising:

a trigger device comprising a trigger element and a low energy wireless transmitter for broadcasting an alert message for a predetermined alert period in unlicensed spectrum for mobile user devices when the trigger element is activated, the alert message comprising a unique trigger device identifier;

a remote server system storing information that identifies the trigger device, the remote server being configured to:

receive, through a network, an alert notification message from each of a plurality of mobile user devices, each alert notification message indicating that the mobile user device has received the an alert message from the trigger device and including the unique trigger device identifier and a unique user identifier associated with the mobile user device;

associate a plurality of the alert notification messages with the alert message from the trigger device by comparing timing information for the alert notification messages with the predetermined alert period;

receive, through the network, an alert acceptance request message from one of the mobile user devices that includes the unique trigger device identifier and the unique user identifier associated with the mobile user device; and send notification messages to at least the mobile user devices that did not send the alert acceptance request message, the notification messages indicating that the alert message from the trigger device has been accepted by one of the plurality of mobile user devices.

* * * * *